US011065733B2

(12) United States Patent
Thysell

(10) Patent No.: US 11,065,733 B2
(45) Date of Patent: Jul. 20, 2021

(54) METHODS AND TOOL FOR MAINTENANCE OF HARD SURFACES, AND A METHOD FOR MANUFACTURING SUCH A TOOL

(71) Applicant: TWISTER CLEANING TECHNOLOGY AB, Soderkoping (SE)

(72) Inventor: Hakan Thysell, Soderkoping (SE)

(73) Assignee: TWISTER CLEANING TECHNOLOGY AB, Soderkoping (SE)

( * ) Notice: Subject to any disclaimer, the term of this patent is extended or adjusted under 35 U.S.C. 154(b) by 0 days.

(21) Appl. No.: 16/102,299

(22) Filed: Aug. 13, 2018

(65) Prior Publication Data

US 2018/0345438 A1 Dec. 6, 2018

Related U.S. Application Data

(63) Continuation of application No. 15/707,262, filed on Sep. 18, 2017, now abandoned, which is a (Continued)

(30) Foreign Application Priority Data

Mar. 15, 2005 (EP) ..... 05005570

(51) Int. Cl.
*B24D 13/14* (2006.01)
*B24B 7/18* (2006.01)
(Continued)

(52) U.S. Cl.
CPC ..... *B24B 7/186* (2013.01); *B24B 7/18* (2013.01); *B24B 23/02* (2013.01); *B24D 11/001* (2013.01); *B24D 13/14* (2013.01); *B24D 13/147* (2013.01)

(58) Field of Classification Search
CPC .. B24B 7/18; B24B 7/186; B24B 7/22; B24B 7/224; B24B 23/02; B24D 11/01;
(Continued)

(56) References Cited

U.S. PATENT DOCUMENTS 2,925,593 A 2/1960 Fialkoff
2,958,593 A * 11/1960 Hoover ..... A47L 13/04 451/532
(Continued)

FOREIGN PATENT DOCUMENTS

DE 693 02 736 T2 12/1996
EP 0 536 919 A2 4/1993
(Continued)

OTHER PUBLICATIONS

Extended European Search Report dated Feb. 21, 2020 in European Patent Application No. 19193298.7.
(Continued)

*Primary Examiner* — Eileen P Morgan
(74) *Attorney, Agent, or Firm* — Oblon, McClelland, Maier & Neustadt, L.L.P.

(57) ABSTRACT

A method is disclosed for treating or maintaining a hard surface comprising a stone or stone-like material, the method comprising treatment of the surface with a flexible pad, in the presence of abrasive particles, bonded to the pad, on a contact surface between the pad and the hard surface, wherein the abrasive particles comprise diamond particles, and the treatment is performed in the absence of an effective amount of crystallization agent on the contact surface. The treatment is performed on a substantially regular basis, such as daily, weekly or monthly, and the treatment is performed using a pad comprising an open, lofty, three dimensional non-woven webs of fibers. A tool for use in the method is also provided, as well as a floor-surfacing machine com-
(Continued)

prising such a tool and a method for manufacturing such a tool. Furthermore, methods for treating or maintaining hard, smooth surfaces such as wood, polymer material, lacquer, linoleum, gelcoat, glass and automotive enamel are disclosed.

9 Claims, 5 Drawing Sheets

Related U.S. Application Data continuation of application No. 15/407,694, filed on Jan. 17, 2017, now abandoned, which is a continuation of application No. 13/101,224, filed on May 5, 2011, now abandoned, which is a continuation of application No. 12/976,558, filed on Dec. 22, 2010, now abandoned, which is a continuation of application No. 11/886,546, filed as application No. PCT/EP2005/012360 on Nov. 16, 2005, now abandoned, which is a continuation of application No. 11/079,081, filed on Mar. 15, 2005, now Pat. No. 10,065,283.

(51) Int. Cl.
*B24B 23/02* (2006.01)
*B24D 11/00* (2006.01)

(58) Field of Classification Search
CPC .... B24D 13/147; B24D 11/00; B24D 11/001; B24D 13/14
USPC ..... 451/28, 49, 353, 359
See application file for complete search history.

(56) References Cited

U.S. PATENT DOCUMENTS 3,020,139 A 2/1962 Camp et al.
3,324,609 A 6/1967 Stein et al.
3,527,001 A 9/1970 Kleemeier et al.
3,537,121 A * 11/1970 McAvoy ..... C11D 17/049 15/230.12
3,699,672 A 10/1972 Sims
4,078,340 A 3/1978 Klecker et al.
4,227,350 A 10/1980 Fitzer
4,287,685 A 9/1981 Marton
4,437,271 A * 3/1984 McAvoy ..... A47L 11/164 15/230.12
4,537,802 A 8/1985 Flanagan
4,609,380 A 9/1986 Barnett et al.
4,874,478 A 10/1989 Ishak et al.
4,893,439 A * 1/1990 McAvoy ..... B24D 11/001 15/230
4,893,493 A 1/1990 Jacques et al.
5,000,761 A 3/1991 Mayton et al.
5,030,496 A * 7/1991 McGurran ..... A47L 13/17 15/229.12
5,054,245 A 10/1991 Coty
5,249,961 A 10/1993 Hoagland
5,282,900 A * 2/1994 McDonell ..... A47L 13/17 134/2
5,429,545 A 7/1995 Meyer
5,454,751 A 10/1995 Wiand
5,458,962 A * 10/1995 Birch ..... A47L 11/164 15/209.1
5,504,245 A 4/1996 Liang et al.
5,551,960 A 9/1996 Christianson
5,573,844 A 11/1996 Donovan et al.
5,591,239 A 1/1997 Larson et al.
5,928,070 A * 7/1999 Lux ..... B24D 3/00 451/526
6,234,886 B1 5/2001 Rivard et al.
6,261,164 B1 * 7/2001 Rivard ..... A47L 11/164 451/353
6,833,014 B2 12/2004 Welygan et al.
6,991,527 B2 * 1/2006 Linzell ..... B05C 17/002 451/523
2003/0172594 A1 * 9/2003 Castro ..... C04B 35/486 51/307
2004/0029511 A1 * 2/2004 Kincaid ..... B24D 11/005 451/526
2004/0098923 A1 * 5/2004 Hood ..... B24D 3/348 51/296
2005/0130568 A1 * 6/2005 Welygan ..... B24D 3/002 451/59
2005/0233678 A1 * 10/2005 Fritz ..... B24D 7/16 451/28

FOREIGN PATENT DOCUMENTS

EP 562919 * 9/1993
EP 0 397 374 61 8/1994
EP 0 617 099 A1 9/1994
EP 0 623 424 A1 11/1994
EP 0 320 146 B1 4/1996
EP 0 451 944 B1 5/1996
EP 0 562 919 B1 5/1996
EP 1 072 715 A1 1/2001
GB 914315 1/1963
GB 1 348 526 3/1974
JP 2-59272 2/1990
JP 4-82673 3/1992
JP 7-8433 1/1995
JP 9-35259 2/1997
JP 9-509897 10/1997
JP 2002-209819 7/2002
JP 2004-223701 8/2004
RU 2 153 839 C1 8/2000
RU 2 181 024 C1 4/2002
SU 1373741 A1 2/1988
WO WO 95/23539 9/1995
WO WO 95/23593 9/1995
WO WO 96/21058 7/1996
WO WO 03/075734 A1 9/2003
WO WO 2005/072440 A2 8/2005
WO WO 2006/031475 A1 3/2006

OTHER PUBLICATIONS

Declaration of Louis Charmoille, Technical Manager of 3M France dated Apr. 3, 2007 with 12 Exhibits.
"Abrasives" Kirk-Othmer Encyclopedia of Chemical Technology. Copyright © 2002 by John Wiley & Sons, Inc., Article Online Posting Date: Dec. 20, 2002, Abstract-pages 1-Article-pages 1-25.
Declaration of David Knight, Key Account Manager of 3M United Kingdom PLC dated Feb. 27, 2008 with 1 Exhibit.
Press Release—"3M Adds Scotch-Brite Diamond Floor Pads for Commercial Stone Floor Cleaning", Release date—Feb. 21, 2008—http://news.thomasnet.com/companystory/541162-p. 4.
EPO Summons to attend oral proceedings pursuant to Rule 115(1) EPC, in European Patent Application No. 05005570.6, dated Feb. 6, 2009. 13 pages.
3M Technical Data Sheets, TD101, TD102, TD103, TD106, TD107, ScotchBrite™ May 1997 and Mar. 1999, 5 pages.
3M Floor Pad Application Selection Guide, 6 pages.
3M Technical Data Sheet, TD123, Jul. 2001, 4 pages (with Letter Dated Feb. 7, 2008).
Product Brochure: "3M™ Scotch-Brite™ Plus Purple Diamond Pad", available to the proprietor of the patent on Mar. 27, 2007, 4 pages.
Web page printout from KGS Diamond Technology, "What's New at KGS?", May 7, 2008, 1 page.
Web page printout from KGS Diamond Technology, "Floor Maintenance with KGS Flexis FM", May 7, 2008, 2 pages.
Photographs of 3M Purple Pad and Green HTC Twister Pad, 2 pages.
MSN Encarta definition of "lofty", 3 pages.

(56) References Cited

OTHER PUBLICATIONS

Dictionary.com definition of "lofty", 4 pages.
Merriam-Webster.com definition of "lofty", 2 pages.
Compact Oxford English Dictionary Online definition of "lofty", 1 page.
Screen dumps of slide show from 3M web page, "Scotch-Brite™—50th Anniversary", 3 pages.
KGS Flexis FM Brochure. KGS Diamond Group, SA, 12 pages.
Grounds of Appeal, in European Application No. 05005570.6, Appeal No. T1337/09-3.2.07, Nov. 3, 2009, 37 pages.
"The Crystallization of Marble-Type Stones", Translated from "Batiment et Entretien", Jan.-Feb. 1985, 9 pages.
Determination of the effective solution of Crystallization liquid, HTC Sweden AB, test report. Aug. 2009, 7 pages.
Notes from Lars Lindgren, CEO of Nordstjernan Industriutveckling, May 11, 2006, 7 pages (with English-language Translation).
E-mail message from TC Contractors to HTC Sweden, Mar. 5, 2006, 2 pages.
Twister Technical Data Sheet, Twister II. Twister Universal, floor pad for daily maintenance, HTC Sweden AB, 2 pages (with Letter Dated Nov. 3, 2009).
Kleever K2 Product Sheet, Kleever K2 crystallization product for white or clear colors, Coor & Kleever, SA, 1 page.
Combined amendment request form and statement of proposed amendments, replacement specification pp. 15a, 15b, 32 and 34, and marked-up copies of replaced specification pp. 15a, 15b, 32 and 34 in Australian Patent Application No. 2005329313, Nov. 27, 2007, 10 pages.
Examiner's first report on Australian Patent Application No. 2005329313, dated Feb. 15, 2008, 2 pages.
Statement of Proposed Amendments, Replacement Specification Pages, and Marked-up Copies of Replaced Specification Pages in Australian Patent Application No. 2005329313, dated Jun. 16, 2008, 10 pages.
Statement of Proposed Amendments, Replacement Specification Pages, and Marked-up Copies of Replaced Specification Pages, in Australian Patent Application No. 2005329313, Dec. 9, 2008, 16 pages.
Notice of Acceptance, in Australian Patent Application No. 2005329313, Jan. 5, 2009, 3 pages.
Combined Amendment Request and Statement of Proposed Amendments, Replacement Specification Pages, and Marked-up Copies of Replaced Specification Pages, in Australian Patent Application No. 2005329313, Apr. 29, 2009, 9 pages.
Examiner's Report No. 2 on Australian Patent Application No. 2005329313, dated Jul. 2, 2008, 6 pages.
Examiner's First Report on Australian Patent Application No. 2007216871, dated Feb. 15, 2008, 2 pages.
Statement of Proposed Amendments, Replacement Specification Pages, and Marked-up Copies of Replaced Specification Pages, in Australian Patent Application No. 2007216871, dated Jun. 16, 2008, 9 pages.
Combined Amendment Request and Statement of Proposed Amendments, Replacement Specification Pages, and Marked-up Copies of Replaced Specification Pages, in Australian Patent Application No. 2007216871, dated Apr. 29, 2009, 7 pages.
Notice of Acceptance, in Australian Patent Application No. 2007216871, dated Jul. 1, 2008, 2 pages.
Examiner's Report No. 2 on Australian Patent Application No. 2007216870, dated Jul. 3, 2008, 2 pages.
Statement of Proposed Amendments, Replacement Specification Pages, and Marked-up Copies of Replaced Specification Pages, in Australian Patent Application No. 2007216870, dated Aug. 19, 2008, 7 pages.
Combined Amendment Request Form and Statement of Proposed Amendments, Replacement Specification pp. 17, 18, 35 and 37, and Marked-up Copies of Replaced Specification pp. 17, 18, 35 and 37, in Australian Patent Application No. 2007216870, dated Nov. 27, 2007, 10 pages.
Examiner's First Report on Australian Patent Application No. 2007216870, dated Feb. 15, 2008, 2 pages.
Statement of Proposed Amendments, Replacement Specification Pages, and Marked-up Copies of Replaced Specification Pages, in Australian Patent Application No. 2007216870, dated Jun. 16, 2008, 9 pages.
Examiner's Report No. 3 on Australian Patent Application No. 2007216870, dated Sep. 22, 2008, 2 pages.
Statement of Proposed Amendments, Replacement Specification Pages, and Marked-up Copies of Replaced Specification Pages And Annexes A1 to A18, in Australian Patent Application No. 2007216870, dated Jan. 15, 2009, 19 pages.
Notice of Acceptance, in Australian Patent Application No. 2007216870, dated Feb. 3, 2009, 3 pages.
Combined Amendment Request and Statement of Proposed Amendments, Replacement Specification Pages And Marked-up Copies of Replaced Specification Pages, in Australian Patent Application No. 2007216870, dated Apr. 29, 2009, 8 pages.
Statement of Proposed Amendments, Replacement Specification Pages, and Marked-up Copies of Replaced Specification Pages, in Australian Patent Application No. 2009201268, dated May 22, 2009, 22 pages.
Amendment as Filed in Application No. PI0520125-0, dated Jan. 21, 2008, 14 pages.
Office Action, in Canadian Patent Application No. 2,600,958, dated May 12, 2009, 3 pages.
Office Action, in Canadian Patent Application No. 2,600,958, dated Nov. 19, 2009, 3 pages.
First Office Action, in Chinese Patent Application No. 2005800497437, dated Dec. 5, 2008, 12 pages (with English-language Translation).
Second Office Action, in Chinese Patent Application No. 2005800497437, dated Nov. 27, 2009, 14 pages (with English-language Translation).
First Office Action, in Chinese Patent Application No. 2007103054484, dated Mar. 25, 2009, 7 pages (English-language Translation only).
Second Office Action, in Chinese Patent Application No. 2007103054484, 5 pages (English-language Translation only).
Notification of Grant Patent Right, in Chinese Patent Application No. 200710305449.9, dated Aug. 28, 2009, 3 pages (with Letter dated Sep. 7, 2009).
First Office Action, in Chinese Patent Application No. 200710305449.9, 2 pages (English-language Translation only).
Letter Reporting Office Action, in Patent Application No. PCT 975/2007, dated Feb. 18, 2010, 2 pages.
Office Action, in European Application No. 07101889.9, dated Apr. 14, 2010, 2 pages.
Communication Pursuant to Article 94(3) EPC, in European Application No. 07101889.9, dated Jun. 16, 2009 5 page.
Extended European Search Report, in European Patent Application No. 07101889.9, dated Jun. 22, 2007, 6 pages (with Cover Letter dated Jul. 4, 2007).
Response to Grounds of Appeal filed by HTC Sweden AB, in European Patent No. 1702714, Apr. 7, 2010, 16 pages.
Response to Grounds of Appeal, in European Patent No. 1702714, dated Apr. 16, 2010, 11 pages.
Minutes of the Oral Proceedings before the Opposition Division, in European Patent Application No. 05005570.6, May 26, 2009, 2 pages.
Decision Revoking the European Patent (Art. 101(2) and 101(3)(b) EPC) and the Reasons for the Decision, in European Patent Application No. 05005570.6, Jun. 23. 2009, 32 pages.
"Protection and Maintenance of Stone Floors", Johnson-Diversey, 2005, 6 pages.
Ed Michels and Jim Harrison, "Cost-effective maintenance of stone flooring", Cleaning & Maintenance Management, Apr. 2008, 3 pages.
3M Technical Data: 3M Diamond Discs, "Commercial Care and Home Care Divisions and Food Services Trade Department", 1995, 5 pages.
Test Report: "The 3M Red and 3M Green & Orange non-diamond pads compared to Twister Green diamond pad—Maintaining high gloss", Sep. 2008, 5 pages.

(56) References Cited

OTHER PUBLICATIONS

Test Report: "The 3M non-diamond pads compared to the Twister Green diamond pad—Raise gloss", Sep. 2008, 4 pages.
Test Report: "The 3M Red and 3M Green & Orange non-diamond pads compared to Twister Green diamond pad—Raise gloss", Apr. 2009, 3 pages.
3M Brochure: "Stone Floor Cleaning and Polishing Made Easier", 3M Building and Commercial Services Division, 2008, 4 pages.
3M Marketing Support Materials: "The Originators are Still the Innovators", 3M Building and Commercial Services, 2008, 25 pages.
The National Terrazzo and Mosaic Association: "Specifications—What is Terrazzo", web page archived by www.archive.org on Mar. 5, 2005, 1 page.
The National Terrazzo and Mosaic Association: "Specifications—Divider Strips", web page archived by www.archive.org on Mar. 8, 2005, 1 page.
Swedish Court of Appeals decision of Apr. 2, 2009, Case No. Ö 5375-08, 19 pages (with Official English-language Translation).
Declaration of Mr. Christer Kjellén, owner of Stenutveekiing Nordiska AB, 2 pages.
Test Report: "Investigation of loss of weight (abrasion) of marble and terazzo floorings by use of Twister system", Dec. 6, 2006, 10 pages.
Declaration of Kjell Svensson, CEO and main owner of Bevara AB, Apr. 22, 2009, 4 pages (with English-language Translation).
Technical Data Sheet TD 112, 3M ScotchBrite™ Orange & Green Floor Pad for Pre-Burnishing, Commercial Care Laboratory Europe, May 1997, 1 page.
Declaration of Mr. Martin Lutz, CEO & Technical Director of FIGR Forschungs-und Prüfinstitut für Facility Management GmbH, 2 pages.
Natursten Skötsel Inomhus, Sveriges Stenindustriförbund, 12 pages.
Office Action, in European Application No. 05005570.6, dated Feb. 6, 2009, 7 pages.
Decision to grant a European patent pursuant to article 97(2) EPC, in European Patent Application No. 05005570.6, dated Apr. 13, 2007, 2 pages.
"The 3M Red, White and Green & Orange non-diamond pads compared to Twister", Oct. 26, 2009, 6 pages.
Communication under Rule 51(4) EPC, in European Application No. 05005570.6, dated Sep. 28, 2006, 30 pages.
Result of consultation of May 31, 2006, in European Application No. 05005570.6, Jul. 17, 2006, 2 pages.
Communication pursuant to Article 96(2) EPC, in European Application No. 05005570.6, dated Dec. 12, 2005. 4 pages.
Communication, in European Patent Application No. 05005570.6, dated Aug. 4, 2005, 6 pages (with European Search Report dated Jul. 26, 2005).
Summons to attend oral proceedings pursuant to Rule 115(1) EPC, in European Application No. 05811584.1, dated Apr. 14, 2010, 6 pages.
Communication pursuant to Article 94(3) EPC, in European Patent Application No. 05811584.1, dated Jun. 16, 2009, 3 pages.
Communication pursuant to Article 94(3) EPC, in European Patent Application No. 05811584.1. dated Aug. 4, 2008, 11 pages.
PCT International Preliminary Report on Patentability (Form PCT/IPEA/409), in International Application No. PCT/EP2005/012360, dated Dec. 14, 2006, 17 pages (with Notification of Transmittal of the International Preliminary Report on Patentability, Form PCT/IPEA/416).
Notification on the Result of Substantive Examination According to Article 52 (1) of Law No. 14 of 2001 on Patent, in Indonesian Application No. P-00200700495, dated Jun. 4, 2009, 4 pages (with English-language Translation).
Notice of Preliminary Dismissal of Divisional Application dated Nov. 24, 2009, in Korean Patent Application No. 10-2007-023991, 2 pages (with English-language Translation).
Notice of Preliminary Rejection dated Nov. 24, 2009, in Korean Patent Application No. 10-2007-7023992, 6 pages (with English-language Translation).
Letter reporting First Office Action dated Sep. 17, 2009, in Mexican Patent Application No. MX/A/2007/011295, Oct. 16, 2009, 23 pages (with First Office Action dated Sep. 17, 2009).
Second Office Action, in Mexican Patent Application No. MX/A/2007/011295, dated Mar. 26, 2010, 2 pages.
Opinion, in Norwegian Patent No. 20072239, Dec. 1, 2009. 2 pages.
Opinion, in Norwegian Patent No. 20072239, May 27, 2009, 2 pages.
Opinion, in Norwegian Patent No. 20072239, Apr. 29, 2008, 1 page.
Opinion, in Norwegian Patent No. 20072239, Apr. 1. 2008, 3 pages.
Rejection, in Norwegian Patent No. 200722391, May 5, 2010, 2 pages.
Examination Report, in New Zealand Patent Application No. 561330, dated Nov. 30, 2007, 2 pages.
Examination Report, in New Zealand Patent Application No. 561330, dated Dec. 5, 2008, 1 page.
Examination Report, in New Zealand Patent Application No. 561330, dated Aug. 7. 2008, 1 page.
Examination Report, in New Zealand Patent Application No. 561330, dated May 1, 2009, 2 pages.
Examination Report and Notice of Acceptance of Complete Specification, in New Zealand Patent Application No. 561330, dated May 27, 2009, 2 pages.
Examination Report, in New Zealand Patent Application No. 563701, dated Nov. 29, 2007, 2 pages.
Examination Report, in New Zealand Patent Application No. 563701, dated Dec. 5, 2008, 1 page.
Examination Report, in New Zealand Patent Application No. 563701, dated Aug. 11, 2008, 1 page.
Examination Report, in New Zealand Patent Application No. 563702, dated Nov. 29, 2007, 2 pages.
Official Action as to Form, in Russian Application No. 2007138038120(041613), dated Dec. 27, 2007, 2 pages (with English-language Translation).
Official Action, in Russian Application No. 2007138038/02(041613), dated Mar. 12, 2009, 8 pages (with English-language Translation).
Decision on Grant Patent for Invention, in Russian Application No. 2007138038/02(041613), dated May 26, 2009, 12 pages (with English-language Translation).
Official Action, in Russian Application No. 2008102827/02(003081), dated Apr. 2, 2009, 7 pages (with English-language Translation).
Decision on Grant Patent for Invention, in Russian Application No. 2008102827/02(003081), dated Jul. 1, 2009, 11 pages (with English-language Translation).
Official Action, in Russian Application No. 2008102826/02(003080), dated Apr. 2, 2009, 6 pages (with English-language Translation).
Decision on Grant Patent for Invention, in Russian Application No. 2008102826/02(003080), dated Jul. 2, 2009, 12 pages (with English-language Translation).
Auditors, Court of Appeals Judge Christina Boutz, Ingemar Person Court of Appeals Judge and Acting, Appeals Lisa Gunn Fors (Rapporteur), Reporting and Scorer, Plaintiff: HTC Sweden AB, Counterpart: LFV, Stockholm's District Court Decision in Case No. 2008-02-08 T 21323-07, 4 pages (Machine Translation only).
Minutes, Svea Court of Appeal. File Annex 43, Title 02, Case Ö 5375-08, Rotel 0206. Mar. 13, 2009 and Mar. 27, 2009, 10 pages (Machine Translation only).
Stockholm District Court, Div 5, Case No. T 21323-07, 23589-07 T, T, 1952-08 and 4856-08 T, HTC Sweden AB ("HTC")/City Paper & Cleaning Products Hate AB and City Paper & Cleaning Products Syd AB ("City Paper") and by the State Aviation Administration (LFV), patent infringement, Stockholm, May 12, 2009, 1 page (Machine Translation only).
Furnishing of Prescribed Information (PF11B(2004)), Singapore Application No. 200717572-2, Jun. 24, 2008, 2 pages.

(56) References Cited

OTHER PUBLICATIONS

Search Report and Examination Report, Singapore Patent Application No. 200706819-0, Austrian Patent Office Service and Information Center (TRF), dated Sep. 17, 2009, 11 pages (with Letter dated Sep. 30, 2009).
Allocation of Date of Filing, Singapore Patent Application No. 200717573-0, dated Nov. 20, 2007, 1 page.
Formalities Examination—Adverse Report, Singapore Patent Application No. 200717573-0, Nov. 20, 2007, 1 page.
Search Report and Examination Report, Singapore Patent Application No. 200717573-0, Austrian Patent Office Service and Information Center (TRF), dated Sep. 11, 2009, 10 pages (with Letter dated Sep. 25. 2009).
Official Action, Ukraine Application No. 200711351, 5 pages (with Letter dated Feb. 3, 2009).
Official Action of Grant, in Ukraine Application No. 200800823, 9 pages (with Letter dated Jul. 1, 2009).
Brochure: SpinFlex Diamond Cleaning Systems, Concrete Polishing Solutions, 5 pages.
Minutes of the Oral Proceedings of Nov. 11, 2010, European Patent Application No. 05005570.6, Appeal No. T1337/09-3207, 6 pages.
The Cleaning Industry Management Standard, CIMS 1101: 2006, ISSA, Effective Nov. 1, 2006, 16 pages.
2005 Official ISSA 447 Cleaning Times, Specialists of Online Budget Control Tools, www.NPAPER.com, National Paper & Sanitary Supply, 13 pages.
Test Report: "The 3M non-diamond pads compared to Twister", 7 pages.
Test Report: "The 3M Red, White and Green & Orange non-diamond pads compared to Twister", 6 pages.
Test Report: "The 3M White non-diamond pads compared to Twister", 5 pages.
Test Report: "The 3M Green non-diamond pads compared to Twister", 5 pages.
HTC Twister™ Handbook, www.htc-twister.com, 20 pages.
Press Release, "Breaking News—Ecolab and HTC Sweden", HTC Sweden AB, May 11, 2006, 2 pages.
Featured Products, Twister™ Diamond Cleaning System, Continental Commercial Products, Dec. 4. 2009, 1 page.
Press Release, "HTC signs global agreement", HTC Professional Floor Systems, Söderköping, Jul. 2008, 1 page.
Press Release ISS—HTC Twister, 1 page.
Examination Report dated Aug. 3, 2011, in Indian Patent Application No. 4392/CHENP/2007.
Examination Report dated Aug. 3, 2011, in Indian Patent Application No. 4590/CHENP/2007.
Examination Report dated Jul. 29, 2011, in Indian Patent Application No. 4591/CHENP/2007.
Communication of a notice of opposition dated Mar. 20, 2012 in European Patent Application No. 05811584.1-2302.
Communication of a notice of opposition dated Mar. 23, 2012 in European Patent Application No. 05811584.1-2302 (with English-language Translation).
Appeal Borad's Questioning dated Mar. 6, 2012 in Japanese Patent Application No. 2008-501169 (with English-language Translation).
Technical Data: 3M Diamond Abrasive & Drive Pad for Marble Floor, TD 123, Commercial Care Laboratory Europe, Jul. 2001, 1 page.
Definition of Linoleum from Wikipedia, http://en.wikipedia.org, Mar. 12, 2012, 4 pages.
Communication of a notice of opposition dated Apr. 18, 2012 in European Patent Application No. 07101889.9-2302 (with corresponding document).
Office Action dated May 30, 2012, in Chinese Patent Application No. 200580049743.7 (with English-language Translation).
Office Action dated Jul. 25, 2013, in European Patent Application No. 05 811 584.1.
Office Action dated Aug. 12, 2013, in European Patent Application No. 07 101 889.9.
Office Action dated Jul. 24, 2013, in European Patent Application No. 10 184 106.2.
Office Action dated Jul. 24, 2013, in European Patent Application No. 10 184 173.2.
Office Action dated Jul. 24, 2013, in European Patent Application No. 10 184 083.3.
Office Action dated Feb. 14, 2014, in European Patent Application No. 05 811 584.1.
Office Action dated Mar. 10, 2014, in European Patent Application No. 07 101 889.9.
Test Data: 1200 Aluoxid—Terrazzo with wear 6% Red Twister; 500 Aluoxid—Terrazzo with wear 6% Red Twister; Green Twister with wear 6% Red Twister—Plastic floors; 1200 Aluoxid with wear 6% Red Twister—Plastic floors, 2 pages.
Summary cleaning project Danderyd Hospital, Evaluation Performed during Nov. 23, 2009 to Jan. 5, 2010, 9 pages (with English-language Translation).
Micro-Mesh Grit Size Conversion Chart, Oct. 18, 2004, 1 page.
Wikipedia Extract, "Glossmeter", Mar. 30, 2012, 4 pages.
Glossmeter: Revision History, Wikipedia, Nov. 5, 2012, 2 pages.
Declaration, Daniel Westling and test "The 3M Red and 3M Green & Orange non-diamond pads compared to Twister Green diamond pad-Maintaining high gloss", 6 pages.
Declaration, Birger Elofsson and Cleaning and Gloss Test: "Testing Cleaning Performance of Pads with Different Abrasives", HTC Cleaning Test Page, 4 pages.
Declaration, Birger Elofsson and Cleaning Test: "Testing Cleaning Performance of Pads with Different Abrasives", HTC Cleaning Test Page, 6 pages.

* cited by examiner

METHODS AND TOOL FOR MAINTENANCE OF HARD SURFACES, AND A METHOD FOR MANUFACTURING SUCH A TOOL

CROSS-REFERENCE TO RELATED APPLICATIONS

This application is a continuation application of and claims the benefit of priority under 35 U.S.C. § 120 to U.S. Ser. No. 15/707,262, filed Sep. 18, 2017, which is a continuation application of U.S. Ser. No. 15/407,694, filed Jan. 17, 2017, which is a continuation of U.S. Ser. No. 13/101,224, filed May 5, 2011, which is a continuation application of U.S. Ser. No. 12/976,558, filed Dec. 22, 2010, which is a continuation of U.S. Ser. No. 11/886,546 filed Feb. 18, 2009, the entire contents of each of which are incorporated therein by reference. U.S. Ser. No. 11/886,546 is a National Stage of PCT/EP2005/012360 filed Nov. 16, 2005, and claims priority to European Application No. 05005570.6 filed Mar. 15, 2005 and U.S. application Ser. No. 11/079,081 filed Mar. 15, 2005.

TECHNICAL FIELD

The present disclosure relates to a method and a tool for maintenance of hard surfaces, primarily concrete (cement), terrazzo and granite floor surfaces, but also marble or limestone surfaces. The disclosure particularly relates to a method and a tool for maintenance which are suitable for use on a regular basis to maintain a polished hard floor surface.

In addition, the present disclosure relates to methods for maintenance of hard, smooth surfaces, primarily wood, linoleum, lacquer and vinyl floor surfaces. The disclosure particularly relates to a methods for maintenance which are suitable for use on a daily basis to maintain a shiny, hard, smooth surface, such as a floor surface.

BACKGROUND

It is known in connection with cleaning or light polishing of floor surfaces to use a pad in the form of a three-dimensional non-woven web. The pad is usually provided as a circular, disc-shaped body, which is to be disconnectably mounted on a circular carrier plate, which in use is caused to rotate in a plane parallel with the floor surface, such that the pad, when brought into contact with the floor surface, is slightly compressed by the pressure arising between the floor surface and the carrier plate. The carrier plate is usually driven by a motor and may be mounted on a carrier frame, which may be arranged to be pushed or pulled by a walking operator or which may be arranged as a ridable vehicle.

Such pads are formed from fibers of an organic material, e.g. polyamide and/or polyester, particularly polyethylene terephtalate. In some cases the fibers also include natural fibers, such as walnut fibers or coconut fibers.

The fibers of the pad is interconnected at their mutual points of contact by so-called melt bonding, whereby the fibers are subjected to heat that cause the outer part of the fibers to slightly melt and thereby to bond to each other.

Alternatively, or additionally, the fibers may be interconnected at their mutual points of contact by the pad being impregnated with a polymer resin, hereinafter referred to as a "primary binder".

Production of this type of non-woven pads is well known from e.g. U.S. Pat. Nos. 3,537,121, 4,893,439, EP-A-0 397 374, GB-A-11348 526 and EP-B-0 562 919, and thus does not need to be further elaborated on herein.

U.S. Pat. No. 3,537,121 discloses pads for polishing surfaces of aluminum, plastic, wax and similar surfaces. U.S. Pat. No. 3,537,121 also discloses production of such pads. In U.S. Pat. No. 3,537,121 a binder mixed with abrasive particles is applied to the pad by passing the pad between a pair of squeeze rolls, one of which is partially immersed in a container for a mixture of binder resin and abrasive particles, after which the pad is allowed to cure or dry. Thus, in U.S. Pat. No. 3,537,121 a pad is provided, which is entirely impregnated by the binder and abrasive particles.

U.S. Pat. No. 4,893,439 discloses a pad for polishing floor surfaces or aluminum. The pad consists of fibers of organic material and constitutes a lofty open non-woven structure, and contains a binder binding abrasive particles to the fibers. The pad shown in U.S. Pat. No. 4,893,493 has larger voids than that shown in U.S. Pat. No. 3,537,121, and thereby has an improved ability to absorb dirt, so that it can be used for a longer period. Also the pad disclosed in U.S. Pat. No. 4,893,493 is entirely impregnated by binder and abrasive particles.

EP-A-0 397 374 discloses a pad for floor polishing machines, which also is entirely impregnated by binder and abrasive particles.

Pads of the above type are frequently used for so-called "burnishing", i.e. dry polishing (often on a daily basis) of very lightly worn surfaces at high speed (1500-3000 rpm) and relatively low pressure, with a view to restoring a polished surface. This type of treatment is commonly used for both vinyl and marble floorings. Pads suitable for this purpose are available from 3M® under the designation "3M™ Floor Pads", and provide no or little effect on very hard floor surfaces, such as terrazzo or concrete, which have been subject to wear for a longer period of time.

EP-B-0 562 919 discloses a non-woven pad of polymer fiber, which is entirely impregnated by a binder comprising a mixture of curable plastic resin and abrasive particles having a particle size of 0.1-30 μm. As examples of curable resins are mentioned phenol resin, acrylic resins, melamine resin and urea resin. Diamond is mentioned as one among several other examples of plausible abrasive particles. However, according to EP-B-0 562 919, the pad disclosed therein is suitable for treatment of marble floor surfaces, and only in combination with crystallization chemicals, which means that treatment must be made in the presence of liquid containing a salt-forming acid.

The pad in EP-B-0 562 919 is also provided by passing a non-woven pad through a nip between two squeeze rolls, one of which being partially immersed in a binder/abrasive particles mixture, such that the binder and abrasive particles, via the surface of the cylinder is distributed in the pad.

Since the pad disclosed in EP-B-0 562 919 is to be used in the presence of crystallization chemicals, the method described in EP-B-0 562 919 actually constitutes a vitrification method, used with a view to improving the stain resistance and durability of a marble floor. This method is not suitable for daily maintenance purposes, since it involves use of special crystallization chemicals, including acids, which are to react with calcium present in the floor surface to form insoluble calcium salts. Such a method is typically used once in connection with the initial preparation of the polished marble floor, and thereafter at intervals of 6-12 months. The method described in EP-B-0 562 919 is thus too complicated for being used on a daily basis.

Pads of the type referred to in EP-B-0 562 919 are sold by 3M® under the designations "3M™ 5200 Brown Stone Renew Pad" and "3M™ 4000 Grey Stone Polish Pad", and are used for treating marble in the presence of crystallization chemicals and at relatively low speeds (below 250 rpm).

The need for crystallization chemicals, and other surface-improving agents, makes the polishing work more complicated, since the chemicals are to be applied to the surface, possibly followed by removal of excess chemicals, which also contribute to making the polishing work more time consuming. Handling and application of the chemicals also constitute a potential hazard to the environment in general and to the work environment in particular.

It is also known to provide a polished stone or concrete surface by using tools comprising grinding or polishing elements made from a plastic resin mixed with abrasive particles, i.a. diamond particles. Since such elements are fixedly mounted on a usually rotating plate, they do not have the ability to compensate for unevenness in the floor, which may lead to uneven treatment of the floor surface, or to scratching or staining of the floor surface in case such an element is to contact the surface at an excess pressure. Yet another problem is that debris, such as grains of sand, small stones or metal may get stuck in or near the elements and cause scratching of the floor surface. Finally, this type of tools require special machinery capable of applying a higher pressure to the contact surface between the tool and the floor surface.

WO03/075734 discloses a disc-shaped device for cleaning purposes, comprising a nylon scouring material, which is arranged on a rigid disc, whereby grinding elements containing industrial diamonds are placed in recesses in the active scouring surface. A disadvantage with the device disclosed in WO03/07534 is that it does not eliminate the risk of debris getting stuck in or near the grinding elements. Yet another disadvantage is that this tool is complex and therefore more prone to breaking and more difficult and expensive to manufacture.

Hence, there is a need for an improved and simplified method and tool for daily maintenance of hard surfaces. Preferably, the method should be simple to use, e.g. by persons who do not have specialist training in floor surface preparation, and the method should be usable with conventional floor surfacing equipment, e.g. burnishing machines, etc. Also, the tools should be easy to manufacture, not too expensive and durable.

SUMMARY OF THE INVENTION

It is an object to provide an improved technique, which wholly or partially eliminate the problems with the prior art methods and pads. In particular, it is an object to provide a method of treating a hard surface which is more easy to use and which provides a comparable or better result than the prior art methods. In particular, it is an object to provide a method that is suitable for hard, smooth stone or stone-like surfaces.

An additional object is to provide a method of polishing, cleaning or otherwise maintaining hard, smooth and preferably glossy surfaces, in particular floor surfaces, with an eliminated or reduced need for surface-improving or cleaning chemicals.

The invention is based on the idea that abrasive particles in the form of diamond particles provide a polishing effect which is vastly superior to that achievable with those abrasive particles used in the examples shown in e.g. EP-B-0 562 919, and that this polishing effect is so superior as to eliminate the need for crystallization chemicals and other surface-improving agents.

The invention is defined by the appended independent claims. Embodiments are set forth in the dependent claims and in the following description and drawings.

According to a first aspect, there is provided a method for maintaining a hard, smooth surface, the surface comprising a material selected from a group consisting of wood, polymer material, lacquer and linoleum, the method comprising treatment of the surface with a flexible pad, in the presence of abrasive particles, bonded to the pad, on a contact surface between the pad and the hard surface. The abrasive particles comprise diamond particles. The treatment is performed using a pad comprising an open, lofty, three dimensional non-woven web of fibers.

The combination of a flexible pad and diamond particles provides compensation for unevenness in the surface, and distributes the pressure applied to the pad evenly. Also, this combination, through the flexibility of the pad, considerably reduces the risk of the diamonds scratching the surface.

Using diamond particles as abrasive particles when polishing hard, smooth surfaces provides an effect equal to or better than use of conventional abrasive particles, both in wet and dry conditions. In particular, the use of diamonds enables the surface-improving agent to be abolished, thereby eliminating its handling.

The treatment may be performed substantially in the absence of liquid on the contact surface, i.e. under substantially dry conditions; or in the presence of water on the contact surface, i.e. under wet conditions. In particular, the treatment may be performed in the presence of water and a cleaning agent on the contact surface, thereby making it combine excellently with the daily maintenance/cleaning operations.

In one embodiment, the abrasive particles are bonded to the pad by means of a secondary binder. Hence, no abrasives need to be added when treating the floor. Specifically, the abrasive particles may be bonded to the pad only in the vicinity of the contact surface. This is advantageous, since the abrasive particles present in the parts of the pad that are not in contact with the hard surface do not fulfill any function and therefore can be seen as a waste.

The treatment may be performed using a pad having diamond particles of an average diameter of 0.1 to 30 μm, preferably between 0.1 and 15 μm and most preferably between 2 and 15 μm.

The treatment may be performed using a pad having diamond particles comprising at least one of natural diamond particles, industrial diamond particles and coated diamond particles.

The pad may have a density of less than 40 kg/m, preferably 20-35 kg/m$^3$. Thus, the pad comprises a relatively large amount of voids, into which dust, debris and particles may migrate during the treatment. Thus, dust is to a large extent contained in the pad rather than being distributed in the area where the treatment is taking place, eliminating the need for additional dust collecting equipment. Also, by allowing debris to migrate into the pad, the risk for scratching of the surface is reduced.

The hard, smooth surface may be a floor surface.

The pad, while in contact with the hard surface, may be caused to move in relation to the hard surface.

The pad, while in contact with the hard surface, may be caused to rotate at a rotational speed of 50-3000 rpm, preferably of 100-1500 rpm.

In one embodiment, the surface may comprise a polymer material, such as polyvinyl and the treatment may be performed using a pad having diamond particles of an average diameter of between 0.1 and 15 μm and most preferably between 3 and 12 μm.

In another embodiment, the surface comprises linoleum, and the treatment is performed using a pad having diamond particles of an average diameter of between 0.1 and 15 μm, preferably between 3 and 12 μm and most preferably between 3 and 6 μm.

In yet another embodiment the treatment is performed using a pad having diamond particles of an average diameter of between 0.1 and 15 μm, preferably between 3 and 12 μm and most preferably between 3 and 6 μm.

The hard, smooth surface may have a hardness less than about 3 mohs, preferably less than about 2 mohs and most preferably less than about 1 moh.

The treatment may be performed in the absence of an effective amount of surface-improving agents on the contact surface.

The term "surface-improving agents" is understood to include substances that are added when treating the surface to interact with the surface to render the surface more glossy. As examples of surface-improving agents can be mentioned, waxes, oils, resins, varnish and similar products.

Soap, detergents and similar products that are added for cleaning purposes are not considered "surface-improving agents".

The term "effective amount" is understood as an amount that is sufficient to achieve a measurable gloss improvement as compared to the same treatment using a liquid containing no surface-improving agent at all.

The definition of an effective amount may vary in relation to at what interval the treatment is being performed. Hence, for an ad-hoc treatment, i.e. a single occasion, a much higher amount may be needed to achieve a surface-improving effect, than if the treatment was performed with an interval of one or a few days, or even a week. The amount may need to be adjusted to apply to the respective type of surface-improving agent chosen and to the type of surface that is being treated.

According to another aspect, there is provided a method for maintaining a hard, smooth surface, the surface comprising a material selected from a group consisting of a gelcoat, glass and automotive enamel, the method comprising treatment of the surface with a flexible pad, in the presence of abrasive particles, bonded to the pad, on a contact surface between the pad and the hard surface. The abrasive particles comprises diamond particles. The treatment is performed in the absence of an effective amount of surface-improving agents on the contact surface, and the treatment is performed using a pad comprising an open, lofty, three dimensional non-woven web of fibers.

Furthermore, there is provided a method for treating or maintaining a hard surface comprising a stone or stone-like material, the method comprising treatment of the surface with a flexible pad, in the presence of abrasive particles, bonded to the pad, on a contact surface between the pad and the hard surface, wherein the abrasive particles comprise diamond particles, and the treatment is performed in the absence of an effective amount of crystallization agent on the contact surface.

The term "diamond" is understood to include natural diamond as well as synthetic diamond, and diamond particles being coated with any suitable coating, e.g. silver.

The term "effective amount" is understood as an amount that is sufficient to achieve a measurable gloss improvement as compared to the same treatment using a liquid containing no crystallization agent at all. Amounts known to be effective are about 1-2 liters of crystallization agent (comprising 2-30% by weight of e.g. magnesium hexafluorosilicate) per 50 $m^2$ of floor surface for a single treatment operation. Hence, amounts known to be effective on an ad-hoc basis range from about 0.4 g of magnesium hexafluorosilicate per $m^2$ floor surface. However, diluted crystallization agent, e.g. at a ratio of 1:100 is also known to be effective when used repeatedly, e.g. in connection with daily or weekly maintenance. Hence, amounts known to be effective for maintenance on a regular basis range from about 0.004 g of magnesium hexafluorosilicate per m floor surface. It is understood that there are other types of crystallization agents, e.g. zinc hexafluorosilicate, hydrofluoric acid and oxalic acid. The values given above may thus need to be adjusted to apply to the respective type of crystallization agent chosen.

The combination of a flexible pad and diamond particles provides compensation for unevenness in the surface, and distributes the pressure applied to the pad evenly. Also, this combination, through the flexibility of the pad, considerably reduces the risk of the diamonds scratching the surface.

Using diamond particles as abrasive particles when polishing hard stone surfaces provides an effect equal to or better than use of conventional abrasive particles, both in wet and dry conditions. In particular, the use of diamonds enables the crystallization agent to be abolished, thereby eliminating its handling.

The treatment may be performed substantially in the absence of liquid on the contact surface, i.e. during substantially dry conditions; or in the presence of water on the contact surface, i.e. during wet conditions. In particular, the treatment may be performed in the presence of water and a cleaning agent on the contact surface, thereby making it combine excellently with the daily maintenance/cleaning operations.

In one embodiment, the abrasive particles are bonded to the pad by means of a secondary binder. Hence, no abrasives need to be added when treating the floor. Specifically, the abrasive particles may be bonded to the pad only in the vicinity of the contact surface. This is advantageous, since the abrasive particles present in the parts of the pad that are not in contact with the hard surface do not fulfill any function and therefore can be seen as a waste.

The abrasive particles may have an average diameter of 0.1 to 30 μm, preferably between 0.1 and 15 μm and most preferably between 10 and 15 μm.

The abrasive particles may comprise at least one of natural diamond particles, industrial diamond particles and coated diamond particles.

The treatment may be performed using a pad having diamond particles of an average diameter of 0.1 to 30 μm, preferably between 0.1 and 15 μm and most preferably between 5 and 15 μm.

In one embodiment, the pad that is used comprises an open, lofty, three dimensional non-woven web of fibers. Such webs are available at a relatively low cost and in standard sized adapted for the existing surfacing machines.

The pad may have a density of less than 40 $kg/m^3$, preferably 20-35 $kg/m^3$. Thus, the pad comprises a relatively large amount of voids, into which dust, debris and particles may migrate during the treatment. Thus, dust is to a large extent contained in the pad rather than being distributed in the area where the treatment is taking place, eliminating the need for additional dust collecting equipment. Also, by allowing debris to migrate into the pad, the risk for scratching of the surface is reduced.

The method is particularly suitable for use on a floor surface.

The method is particularly applicable where the surface is a stone or stone-like material having a hardness of about 5 moh or more, preferably 6-7 moh. Examples of such surfaces are concrete, terrazzo, granite etc.

The pad, while in contact with the hard surface, may be caused to rotate at a rotational speed of 50-3000 rpm, preferably of 100-1500 rpm.

The treatment may be performed on a substantially regular basis, such as daily, weekly or monthly.

Furthermore, there is provided a tool for treating a hard surface, the tool comprising a flexible pad having an active treatment surface presenting abrasive particles bonded to the pad. The pad presents a first portion wherein said abrasive particles are present in a first concentration, and a second portion having a second, lower concentration of said abrasive particles, said abrasive particles comprising diamond particles.

In one embodiment, the second portion is substantially free from diamond particles.

Since the abrasive particles present in the parts of the pad that are not in contact with the hard surface do not fulfill any function, pads according to this disclosure can be manufactured at a lower cost.

The flexibility of the pad eliminates or reduces the harmful effects that diamond abrasive particles could otherwise have on the hard surface. Hence, the tool may be used for any hard surface, such as surfaces of wood, laminate, marble, granite, concrete, terrazzo, etc. However, the tool is particularly effective for hard stone or stone-like surfaces, such as granite, concrete, terrazzo, etc.

In one embodiment, the pad consists of a disc-shaped body having a thickness and a first surface, wherein said abrasive particles are present on said first surface and down to a depth from said first surface, which depth is less than said thickness, such that said first portion is at said first surface and said second portion is at a second surface, opposite said first surface. By leaving the second surface free from abrasive material and binder, the attachment of the pad to a Velcro hook connector on a carrier plate is facilitated.

In a second embodiment, the pad consists of a disc-shaped body having a thickness and a first surface, wherein said abrasive particles are present over less than the entire first surface, such that said first and second portions are situated adjacent each other at said first surface. This second embodiment facilitates migration of dust and debris into the pad.

In one embodiment, the pad comprises an open, lofty, three dimensional non-woven web, including a plurality of fibers, which are adhered to each other at their points of mutual contact.

The abrasive particles may be bonded to the fibers of the pad by a secondary binder. Hence, the bonding of the fibers of the pad does not in any way need to be negatively affected by the fact that the abrasive particles are only present at the contact surface.

As non-limiting examples, the secondary binder may be selected from a group consisting of phenol resin, melamine resin, urea resin and epoxy resin.

In one embodiment, the secondary binder forms a plurality of distinct droplets having a maximum diameter which is smaller than an average length between two points of mutual contact of a fiber. Thus, the fibers are not entirely coated by the binder resin, facilitating further the migration of dust and debris into the pad.

The abrasive particles may comprise diamond particles having an average diameter of 0.1 to 30 μm, preferably between 0.1 and 15 μm and most preferably between 5 and 15 μm.

The pad may further comprise second abrasive particles selected from a group consisting of graphite, tin oxide, silicon carbide and aluminum oxide.

The pad is preferably provided in the shape of a circular disc having a diameter between 30 and 100 cm and an uncompressed thickness between 1 and 5 cm.

Furthermore, there is provided a method for manufacturing a pad for treating a hard surface. The method comprises: providing a pad, and applying, on a first surface of the pad, a mixture of a binder and abrasive particles including diamond, such that said pad presents a first portion wherein said abrasive particles are present in a first concentration and a second portion, having a second, lower concentration of said abrasive particles. In one embodiment, the second portion is substantially free from said abrasive particles. The abrasive particles may be provided to the first surface by spraying, rolling or dipping.

DESCRIPTION OF EMBODIMENTS

The description will first focus on a tool suitable for use in the method for maintenance of hard surfaces, subsequently on the method for manufacturing the tool, and finally on the use of the tool for maintenance of a hard surface.

Figure 1A:
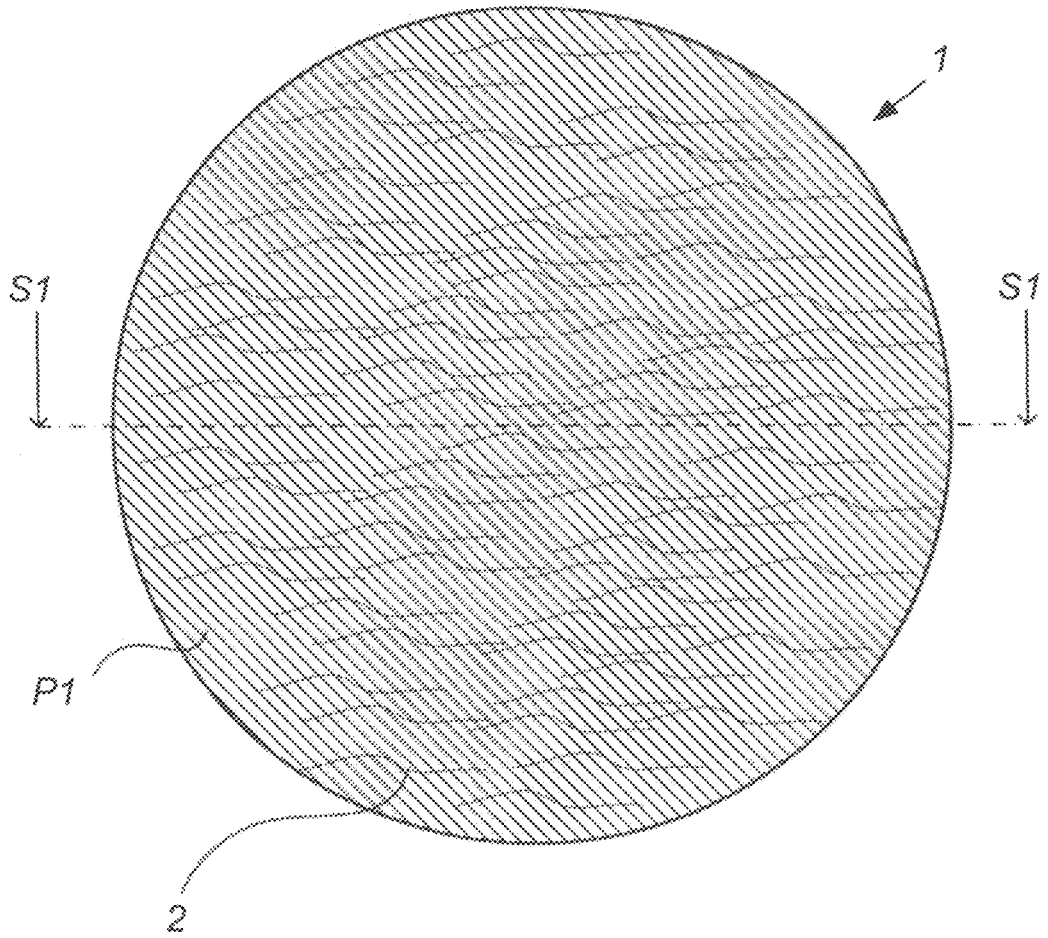
FIGS. 1*a*-1*b* show a pad according to a first embodiment.

Referring to FIG. 1*a*, there is shown a pad 1 made up from an open, lofty three dimensional non-woven web of fibers 2. A first surface of the pad 1 has a portion P1 presenting abrasive particles bonded to the web by means of a secondary binder, i.e. a binder having as a main purpose to bond fibers to the web. The pad 1 is circular in shape.

Figure 1B:
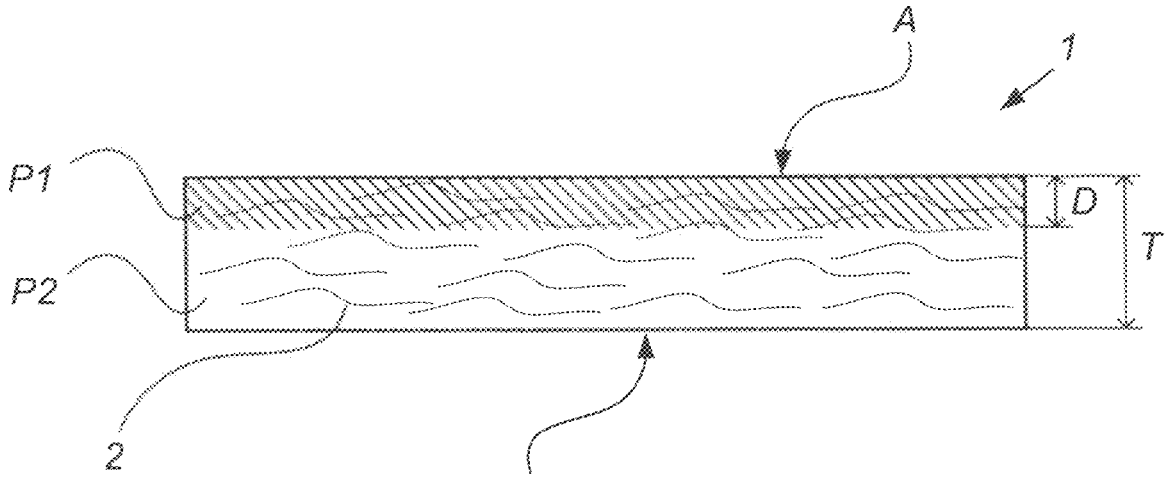

Referring to FIG. 1*b*, a cross section along the line S1-S2 in FIG. 1*a* is shown. As is indicated in FIG. 1*b*, the portion P1 presenting the abrasive particles is present at the first surface A and to a depth D, which is less than the thickness T of the pad 1. Hence, at the second surface B there is a portion P2, which is substantially free from the abrasive particles and the secondary binder.

When referring to "portions", it is to be understood as a portions of the macrostructure of the pad 1 and not portions of the individual fibers.

Figure 2A:
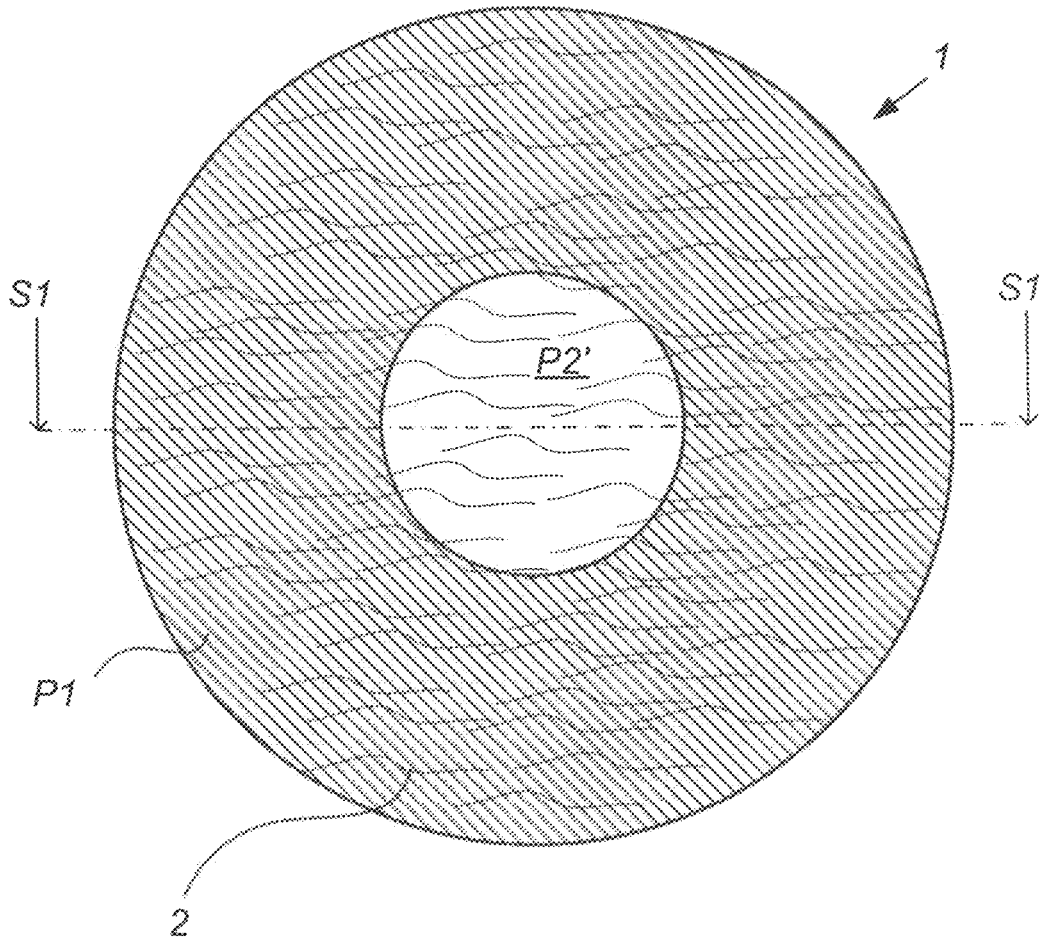
FIGS. 2*a*-2*b* show a pad according to a second embodiment.
Figure 2B:
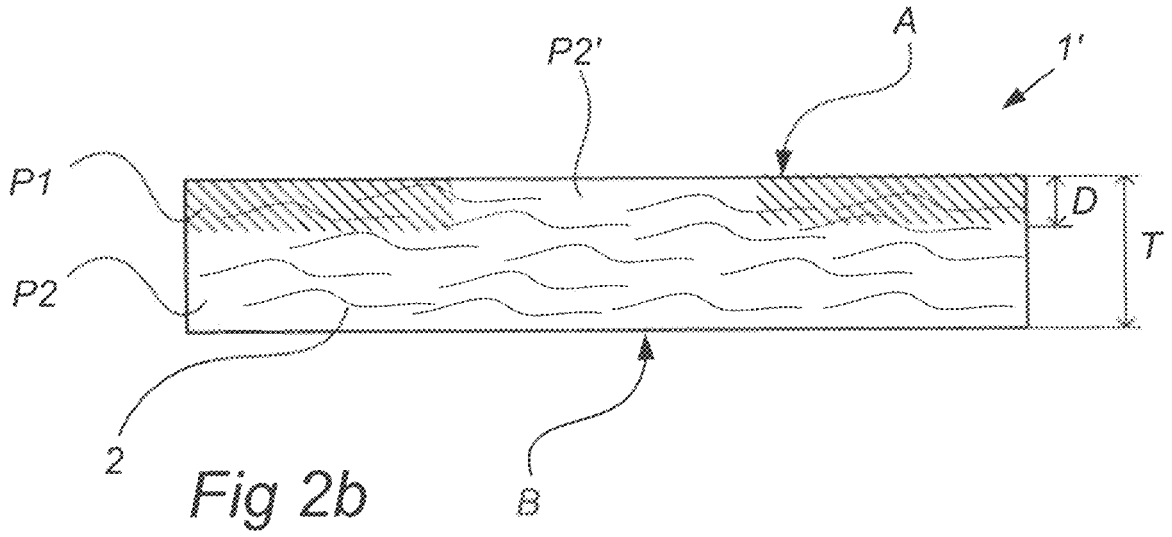

Referring to FIGS. 2*a* and 2*b*, there is shown a similar pad 1, the difference being that there is a portion P2' also at the first surface A, which portion P2' is substantially free from the abrasive particles and the secondary binder.

In both embodiments, the abrasive particles are present throughout the secondary binder, and the fibers are bonded to each other by a primary binder and/or by being melt-bonded.

A description of the preparation of a pad 1 according to the embodiment discussed with reference to FIGS. 1*a* and 1*b* will now be given.

Figure 3A:
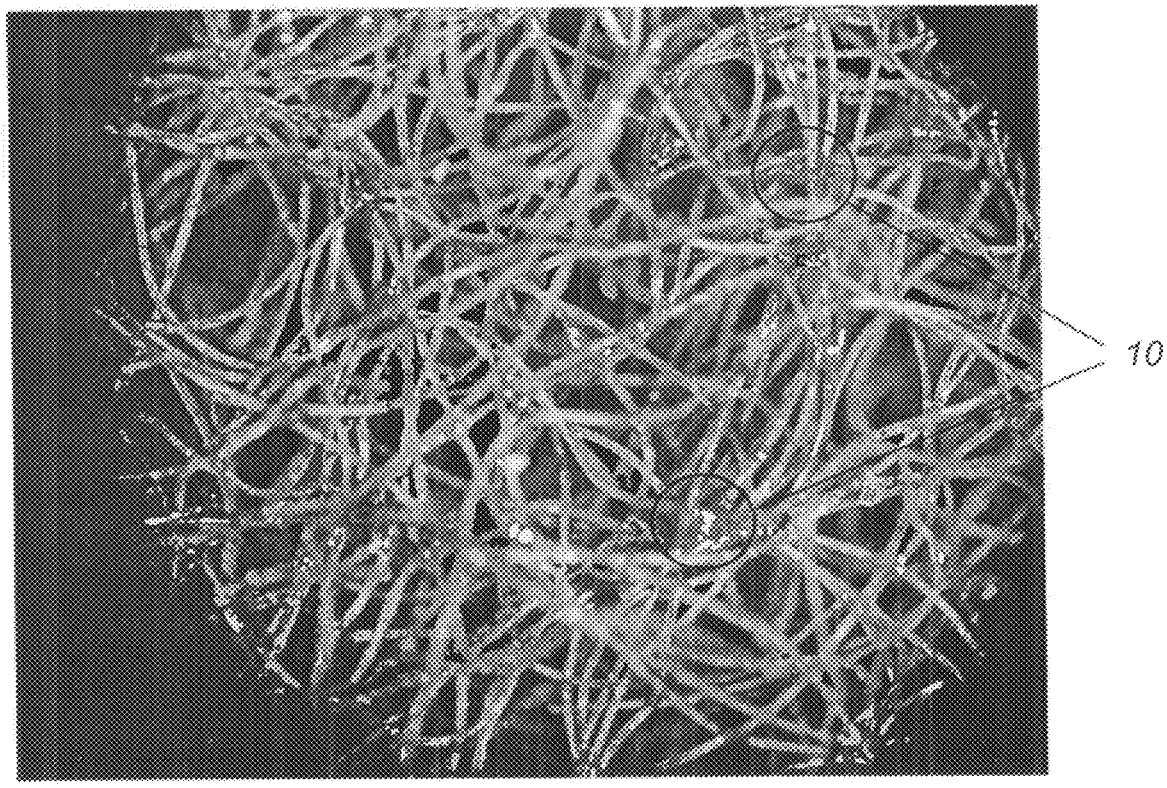
FIGS. 3*a*-3*b* show enlarged photographs of a pad according to the present disclosure, before and after the binder and abrasive particles have been applied.

As a starting material, circular, disc shaped Glit/Microtron® Tan Floor Polishing Pad having a diameter of 20 inches (51 cm), a thickness of 28 mm and a weight of 157 grams was used. Such pads are available from Glit/Microtron, Wrens, Ga., USA. The starting density of the pad was thereby 27 kg/m$^3$. FIG. 3*a* is a microscope photograph showing the pad prior to application of the polymer resin/abrasive particles. From FIG. 3*a*, it can be seen that the fibers constituting the pad are held together at their points 10 of mutual contact by a primary polymer resin. The pad is flexible and resilient and comprises polyester and nylon fibers.

A homogenous polymer resin mixture was prepared, consisting of 200 g PA resin 52-68 phenol resin (available from Perstorp AB, Perstorp, Sweden), 100 g of T-RÖD@ ethanol (available from Alfort & Cronholm AB, Bromma, Sweden) and 20 g of LANDS LS600F 4-8 μm diamond particles (available from Lands Superabrasives, Co., New York, N.Y., USA). Just before application of the mixture, 60 g of 65% p-toluene sulfonic acid (PTS) was added as a hardener.

The resin mixture was sprayed onto a first one A of the surfaces of the polishing pad, using a standard-type compressed air spray gun (normally used for spraying paint). The pad with the uncured resin thereafter weighed 173 grams. Subsequently, the pad was placed in a hot air oven at approximately 120° C. for approximately 20 minutes.

Figure 3B:
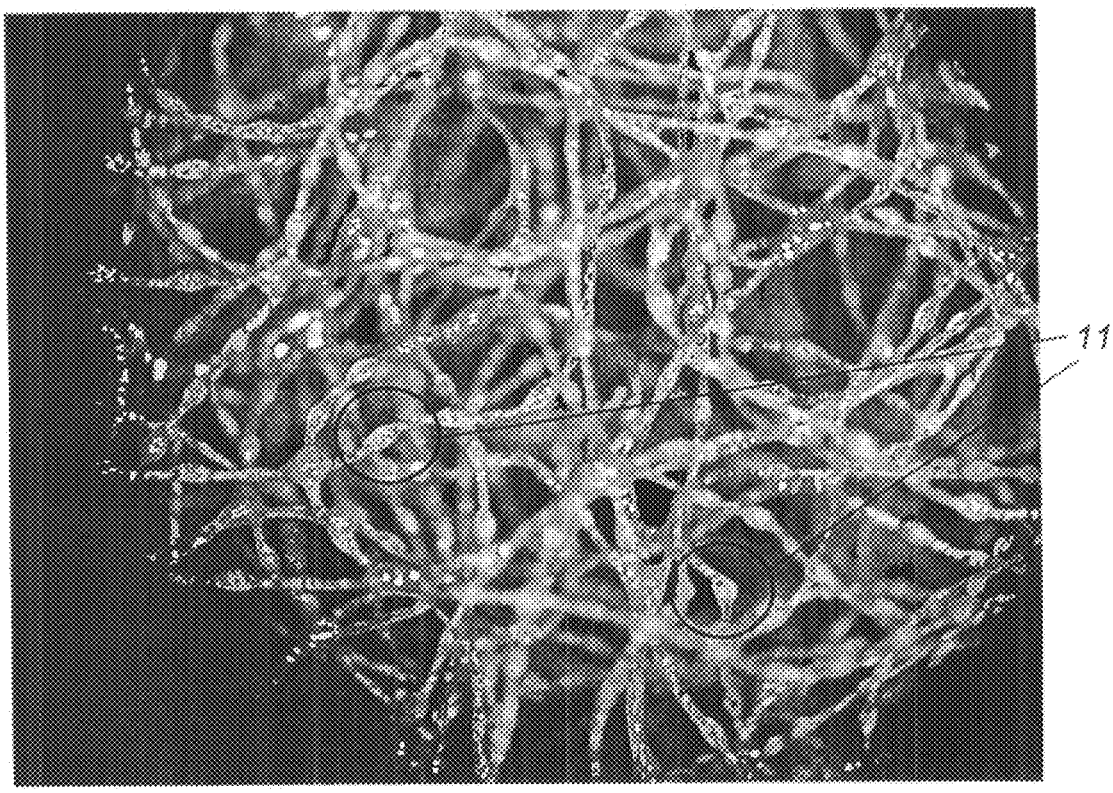
Figures 4A, 4B:
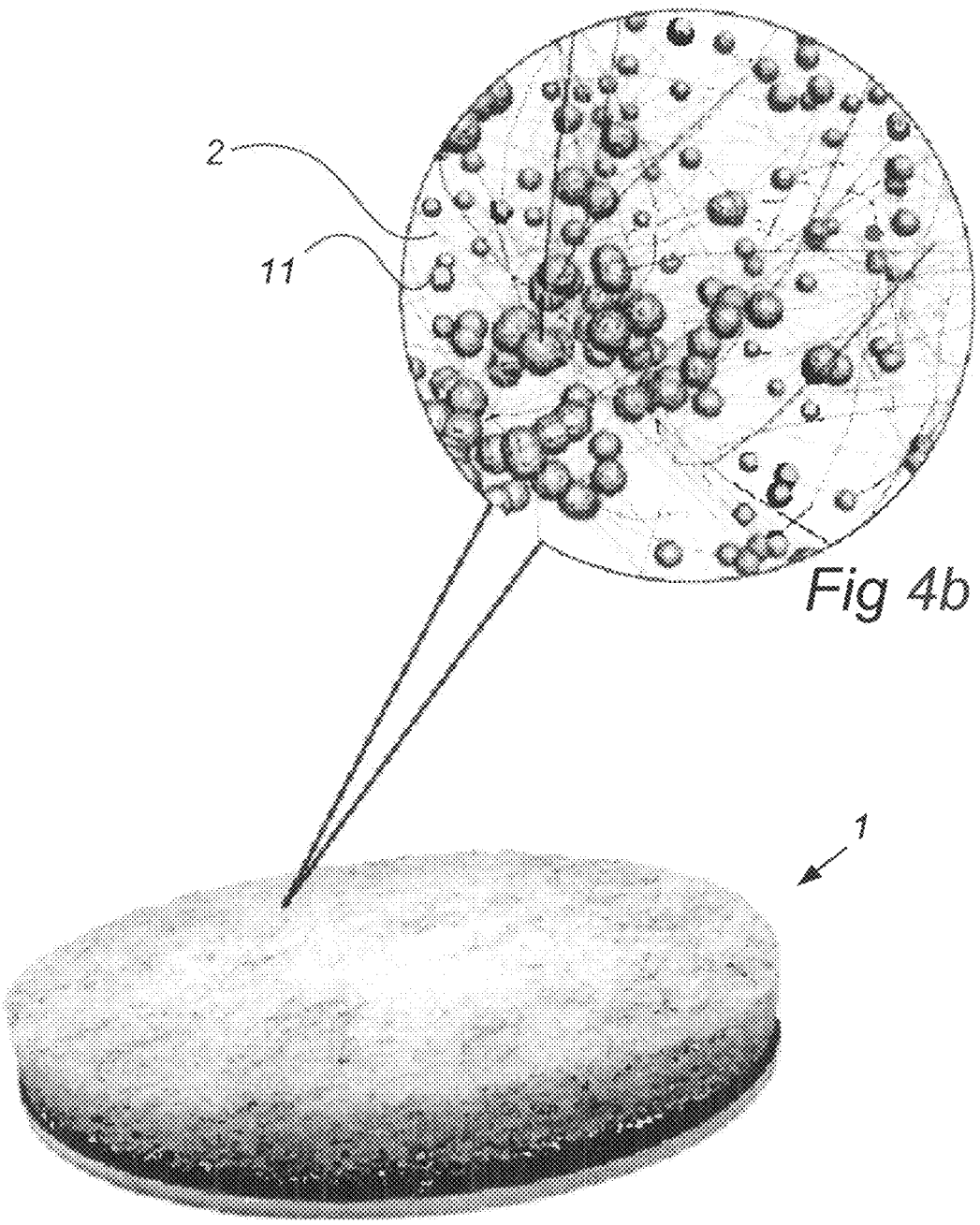
FIGS. 4*a*-4*b* show a diagram of a pad according to the first embodiment, and an enlargement of a portion of the pad.

The pad has now assumed the appearance that can be seen from FIG. 3*b*, which is a microscope photograph. Globules or droplets 11 of the resin/particle mixture are formed along each fiber, also between the fibers' points of mutual contact. The droplets are so distributed that the fibers to which they are adhered are not entirely covered. A more clear illustration of this is found in FIGS. 4*a*-4*b*, which show a pad as described above with reference to FIGS. 1*a*-1*b*, and an enlargement of a portion of that pad (FIG. 4*b*), wherein droplets 11 of binder/particle mixture are attached to the fibers.

In order to evaluate the performance of the pad produced as described above, comparative tests were carried out in order to evaluate two different 20 inch (51 cm) pads, prepared as described above: a first one, referred to as "yellow", having 7-12 μm silver coated diamond particles, and a second one, referred to as "green", having 3-6 μm normal diamond particles. As a reference, two different commercially available pads were used: a 20 inch (51 cm) 3M™ 5200 Brown Stone Renew Pad and a 20 inch (51 cm) 3M™ 4000 Grey Stone Polish Pad were used, both available from 3M, St. Paul, Minn., USA.

The tests were made on two different surface types: Kolmården marble (marble from the Kolmarden area outside Norrköping, Sweden) and K40 concrete. Each test was carried out on a surface of about 1 m$^2$, using a Coor & Kleever Crystallizer 1250KG floor surfacing machine (available from Coor & Kleever, S. A., Barcelona, Spain) having a single carrier plate adapted for receiving a 20 inch floor pad and rotating at about 175 rpm. The test included polishing the surface for about 1 minute/m$^2$. The surface gloss was measured at several spots on the area before and after each treatment using a Sanwal/Cenma IG-310 Glosschecker. The gloss value in the tables below constitute the average value for each area. High gloss is rated 80-90°. Semi gloss is rated 50-75°. Satin is rated 30-45°. Rubbed effect is rated 20-25°. Flat sheen is rated 5-15°.

Each surface was tested both dry and using water as a lubricant. Additionally, the concrete surface was tested using Coor Rosa/K-2 crystallizer (available from Coor & Kleever S. A., Barcelona, Spain) as lubricant, i.e. the crystallization chemical mentioned in EP-B-0 562 919 as comprising magnesium hexafluourosilicate as crystallization agent.

When testing the 3M™ pads, each surface portion was first treated with the brown pad and subsequently with the gray pad.

TABLE 1

Tests performed with water as lubricant on Kolmården marble

| | Pad | | |
|---|---|---|---|
| | Brown | Gray | Green |
| Initial gloss | 17 | 17 | 10 |
| Liquid | Water | Water | Water |
| Final gloss | 17 | 35 | 30 |

TABLE 2

Tests performed without lubricant on Kolmården marble

| | Pad | | |
|---|---|---|---|
| | Brown | Gray | Green |
| Initial gloss | 20 | 25 | 28 |
| Liquid | No | No | No |
| Final gloss | 25 | 30 | 50 |

From tables 1 and 2, it can be concluded that on marble, which is a relatively soft stone having a hardness of about 3-5 moh, and using water as a lubricant, the 3M™ pad combination (brown and gray) provide a slightly better effect, although both the gray and the green pads achieved values falling within the "satin" range. However, during dry conditions, the green pad achieved a remarkable improvement, reaching the semi-gloss range.

TABLE 3

Tests performed with water as lubricant on K40 concrete

| | Pad | | | |
|---|---|---|---|---|
| | Brown | Gray | Yellow | Green |
| Initial gloss | 30 | 29 | 24 | 35 |
| Liquid | Water | Water | Water | Water |
| Final gloss | 29 | 29 | 35 | 46 |

TABLE 4

Tests performed without lubricant on K40 concrete

| | Pad | | | |
|---|---|---|---|---|
| | Brown | Gray | Yellow | Green |
| Initial gloss | 29 | 34 | 30 | 48 |
| Liquid | No | No | No | No |
| Final gloss | 34 | 35 | 48 | 58 |

From Tables 3 and 4, it is noted that in wet conditions and on K40 concrete, having a hardness of about 6-7 moh, the combination of brown and gray pads did not provide any measurable improvement at all, whereas the combination of yellow and green pads provided a distinct improvement. In dry conditions, a small improvement was noted for the surface treated with the combination of brown and gray pads, whereas a major improvement was noted for the surface treated by the combination of yellow and green pads.

TABLE 5

Tests performed with Coor Rosa/K-2 crystallizer as lubricant on K40 concrete

| | Pad | |
|---|---|---|
| | Gray | Green |
| Initial gloss | 41 | 35 |
| Liquid | VMC-Pink | VMC-Pink |
| Final gloss | 45 | 51 |

From table 5, it is noted that some effect is achievable with a gray pad using Coor Rosa/K-2 crystallizer as lubricant on K40 concrete, and that a somewhat better effect is achievable with the green pad using Coor Rosa/K-2 crystallizer as lubricant.

All in all, it is concluded that the pad according to the present disclosure provides a noticeable improvement as compared with the prior art. The improvement is particularly noticeable during dry conditions and on concrete.

Figure 5:
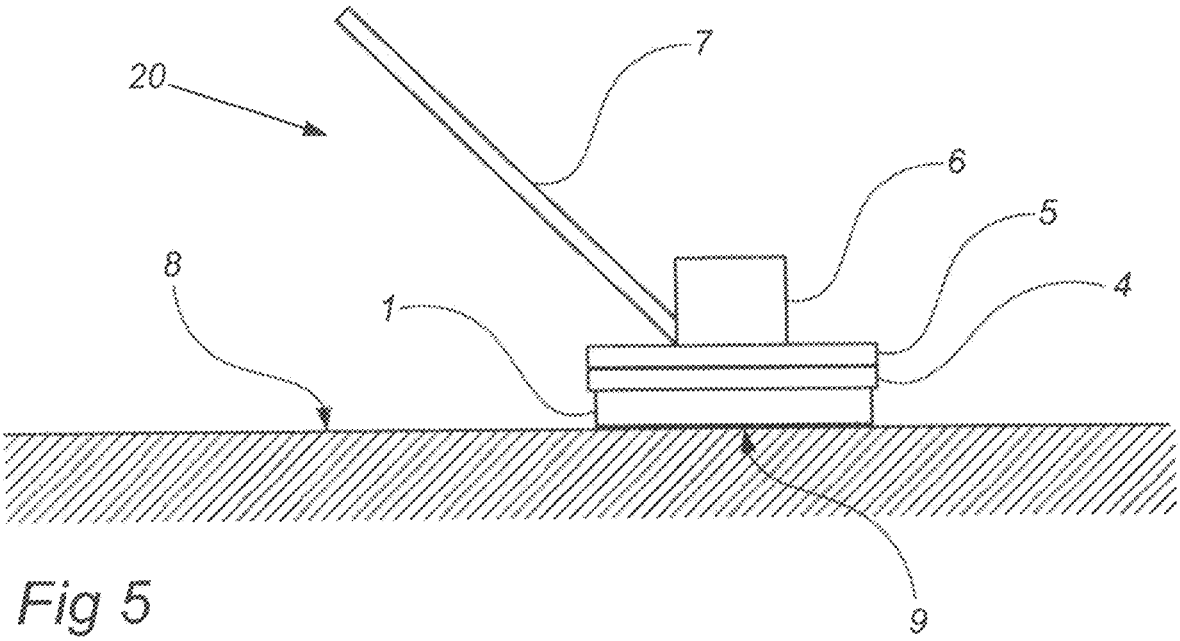
FIG. 5 is a sectional view of a floor surfacing machine on which a pad according to the disclosure is mounted.

FIG. 5 is a sectional view of a floor surfacing machine 20 on which a pad 1 according to the present disclosure is mounted so as to define a contact surface 9 with the hard surface 8, which in this example is a floor surface. The pad 1 is mounted on a driven, rotatable carrier plate 4, which is typically journalled in bearings and thus rotatable relative to a machine body 5, on which a motor unit 6 is arranged. In this embodiment, the machine has a handle 7, and is thus adapted for being held/pushed/pulled by a walking operator. It is recognized that in other embodiments the floor surfacing machine 20 may be e.g. a ridable vehicle fitted with a carrier plate 4 that is adapted for receiving the pad 1.

The pad 1 and method described above can be used for everyday cleaning/maintenance of polished hard surfaces, such as stone, concrete or terrazzo floor surfaces using a floor surfacing machine such as a scrubber/dryer combination machine, e.g. the Nilfisk CR1300; a single disc floor maintenance machines (low speed or high speed), e.g. the Nilfisk 510B or 545; a burnisher, e.g. the Nilfisk SDH5120, BHS5120 or BHS7014, all of which are available from Nilfisk-Advance, Stockholm, Sweden.

The treatment of the floor surface is typically performed by causing the pad, when in contact with the floor surface, to rotate in a plane parallel with the floor surface. Typical rotational speeds are from 50 rpm to 3000 rpm. However, lower or higher rotational speeds are not excluded.

As is clear from the above, a first embodiment of the pad according to the present disclosure comprises an open, lofty, three dimensional non-woven web, including a plurality of fibers, which are adhered to each other at their points of mutual contact by means of a primary binder, and in which abrasive particles are mixed with a secondary binder and applied only to a first surface of the pad, such that the pad is only partially impregnated by the binder/particle mixture. Alternatively, or additionally, the fibers may be melt-bonded to each other.

In a second embodiment of the pad, binder/particle mixture is only applied to parts of said first surface. This can be achieved by masking those parts of the surface to which the binder/particle mixture should not be applied.

In a third embodiment, the pad is entirely impregnated with the binder/particle mixture, e.g. by using such squeeze rollers as are described in EP-B-0 562 919. In a variant of this embodiment, a relatively thin impregnated woven or non-woven pad is attached to a thicker carrier pad in order to provide the flexibility. According to variants of this embodiment, a substantially two-dimensional woven or non-woven web is attached to a thicker carrier pad.

In a fourth embodiment, a three dimensionally woven or knitted pad may be used, whereby the binder/particle mixture is applied as described above.

In a fifth embodiment, the abrasive particles are present in the material of the pad. In a first alternative, the pad is a non-woven fiber pad substantially as described above, with the diamond particles included in the fiber material. In a second alternative, the pad is a polymer foam pad with the diamond particles included in the foamed polymer material.

In a sixth embodiment, the pad is a polymer foam pad, to a surface of which a binder/particle mixture is applied as described above.

The present disclosure is not limited to the use of phenol resin. Other examples of suitable resins are melamine, urea, epoxy and polyester resins.

Furthermore, the hardener may be selected from any hardener suitable for the type of resin selected. Also it is possible not to include the hardener, e.g. by allowing the pad to cure at a higher temperature and/or for a longer period of time.

Also, the solvent (ethanol was used in the example) is provided merely to reduce the viscosity of the mixture and thereby to facilitate spraying thereof. Any suitable solvent may be used, and the solvent may also be excluded, provided that the method of application so allows.

The abrasive particles preferably include diamond. However, floor treatment pads may be produced according to the principles set forth above using other types of abrasive particles, or combinations thereof, as well, e.g. those mentioned in EP-B-0 562 919. In particular silver coated diamond particles have proven to provide good results as well. Naturally, the diamond particles may be combined with other types of abrasive particles.

It is understood that the pad 1 having secondary binder and abrasive particles as described above may be attached to a disc or plate having an arbitrary connector for being connected to a carrier plate of the surfacing machine, or that the pad may be directly connectable to the surfacing machine by means of a Velcro-type hook arrangement provided on the carrier plate, the hooks of which engage the fibers of the pad 1. Hence, the maintenance tool may be composed of the pad with the primary binder, the secondary binder and the abrasive particles, possibly with the addition of dyes or printed areas providing information on the type of pad, manufacturer, trademark etc.

Alternatively, or additionally, the pad may be provided with a backing layer.

Further tests were performed using applicant's yellow and green pads, described above, as well another pad, referred to as "white", having 15-30 μm diamond particles, but otherwise corresponding to the yellow and green pads described above. As a reference, a 3M™ 5100 Red Buffer Pad, available from 3M, St. Paul, Minn., USA, was used.

In a first additional test, the applicant's pads were tested on an oiled oak parquet surface. Gloss values of the floor was measured, before and after treatment, at five spaced apart points using the gloss meter referred to above, whereby an average gloss value was calculated after processing with each pad type. The results are shown in Table 6.

TABLE 6

| dry polishing of oiled oak parquet | | | | |
|---|---|---|---|---|
| | Pad | | | |
| | 3M ® red | White | Yellow | Green |
| Initial gloss | 6.0 | 6.0 | 6.0 | 6.0 |
| Liquid | No | No | No | No |
| Final gloss | 20.2 | 17.0 | 26.0 | 31.4 |

From Table 6, it can be seen that a gloss improvement from a silk matt surface (6.0) is achievable, in particular when using the yellow and white pads, which both provide a very shiny surface. The white pad provided a shiny surface, whereas the 3M® red pad provided a shiny, though somewhat blotchy surface. It was noticed that the white, yellow and green pads provided a very clean floor.

In a second additional test, the applicant's pads were tested for wet polishing of an oiled oak parquet surface. Gloss values of the floor was measured, before and after treatment, at five spaced apart points using the gloss meter referred to above, whereby an average gloss value was calculated after processing with each pad type. The results are shown in Table 7.

TABLE 7

| dry polishing of oiled oak parquet | | | | |
|---|---|---|---|---|
| | Pad | | | |
| | White | Yellow | Green | Green |
| Initial gloss | 6.8 | 6.8 | 6.8 | 6.8 |
| Liquid | Water | Water | Water | No |
| Final gloss | 0.0 | 0.0 | 0.0 | 22.8 |

From Table 7, it can be seen that starting from a silk matt surface, the white and yellow pads provided an entirely matt surface, with some grinding residue being noticeable in the water. The green pad, on the other hand provided a matt, entirely smooth surface. Dry polishing with the green pad provided a shiny and clean surface, entirely free from oil film. It was noticed that the white, yellow and green pads provided a very clean floor. It was also noted that dry polishing of the flooring using the white, yellow or green pads subsequent to the wet polishing, provided gloss values similar to those of Table 6.

Hence, it is concluded that the pad disclosed herein may be used for grinding and/or polishing wood surfaces, such as wood floor surfaces, deck surfaces (on e.g. patios or boats), wall surfaces, interior moldings, doors, baseboards etc.

In a third additional test, the applicant's pads were tested for dry polishing of an Amtico® vinyl tile flooring, available from Amtico International, Coventry, UK, processed with flooring wax to a shiny finish. Initially, the surface had multiple scuff marks. Gloss values of the floor was measured, before and after treatment, at five spaced apart points using the gloss meter referred to above, whereby an average gloss value was calculated after processing with each pad type. The results are shown in Table 8.

TABLE 8

| dry polishing of Amtico ® vinyl flooring | | |
|---|---|---|
| Pad | Gloss | Comment |
| None | 24.8 | Shiny surface, multiple scuff marks |
| 3M ® red | 24.8 | Shiny surface, scuff marks remaining |
| White | 16.4 | Clean, matt surface, no scuff marks |
| Yellow | 19.4 | Clean surface, no scuff marks |
| Green | 24.4 | Very shiny, clean surface |

From Table 8 it is noted that the 3M® red pad, while maintaining the shiny floor surface, did not remove all scuff marks. The white pad removed the scuff marks, at a loss in shininess. With the yellow pad, a more shiny surface was obtainable, with all scuff marks being removed. The green pad provided a surface having practically the same shine as the initial surface, although the scuff marks were entirely removed. It was noticed that the white, yellow and green pads provided a very clean floor.

In a fourth additional test, the applicant's pads were tested for wet polishing of the Amtico® vinyl tile flooring, processed with flooring wax to a shiny finish. Initially, the surface had multiple scuff marks. Gloss values of the floor was measured, before and after treatment, at five spaced apart points using the gloss meter referred to above, whereby an average gloss value was calculated after processing with each pad type. For reference, dry polishing using the green pad was performed. The results are shown in Table 9.

TABLE 9

| wet polishing of Amtico ® vinyl flooring | | | |
|---|---|---|---|
| Pad | Liquid | Gloss | Comment |
| None | None | 24.0 | Shiny surface, multiple scuff marks |
| 3M ® red | Water | 24.8 | Shiny surface, some scuff marks remaining |
| White | Water | 15.2 | Clean, matt surface, no scuff marks |
| Yellow | Water | 19.0 | Clean surface, somewhat more shiny |
| Green | Water | 20.4 | Clean surface |
| Green | None | 26.8 | Very shiny, clean surface |

From Table 9, it is noted that the 3M® red pad once more failed to remove all scuff marks from the floor surface, although providing a shiny surface. The white pad provided a clean, matt surface, whereas the yellow pad provided a clean, slightly more shiny surface. The result from the green pad, when used for wet polishing was moderately better than that of the yellow pad. Once more, the green pad when used in dry conditions provided a very shiny, clean surface. It was noticed that the white, yellow and green pads provided a very clean floor.

In a fifth additional test, the applicant's pads were tested for dry polishing of a linoleum floor surface. The initial surface had been treated with flooring wax. Gloss values of the floor was measured, before and after treatment, at five spaced apart points using the gloss meter referred to above, whereby an average gloss value was calculated after processing with each pad type. The results are shown in Table 10.

TABLE 10

| dry polishing of linoleum surface | | | |
|---|---|---|---|
| Pad | Liquid | Gloss | Comment |
| None | None | 19.0 | |
| 3M ® red | None | 21.0 | No noticeable change |
| White | None | 12.8 | The surface is matted |
| Yellow | None | 21.5 | The surface is perceived as more shiny than reference |
| Green | None | 26.3 | Very shiny and clean surface |

From Table 10, it is noted that whereas the white pad provides a matter surface, the 31M® red pad only provides a slight improvement, whereas the surface processed with the yellow pad is perceived as more shiny than the reference surface. The green pad provides a very shiny and clean surface. It was noticed that the white, yellow and green pads provided a very clean floor.

In a sixth additional test, the applicant's pads were tested for wet polishing of a linoleum floor surface. The initial surface had been treated with flooring wax. Gloss values of the floor was measured, before and after treatment, at five spaced apart points using the gloss meter referred to above, whereby an average gloss value was calculated after processing with each pad type. The results are shown in Table 11.

TABLE 11

| wet polishing of linoleum surface | | | |
|---|---|---|---|
| Pad | Liquid | Gloss | Comment |
| None | Water | 19.0 | |
| 3M ® red | Water | 7.3 | Very matt surface after scouring |
| White | Water | 3.5 | The polished surface removed by scouring |
| Yellow | Water | 7.0 | The polished surface removed by scouring, matt finish maintained |
| Green | Water | 9.8 | Somewhat more shiny than after yellow pad, matt finish |

From Table 11, it is noted that the 3M® red pad provides a very matt surface, while the white pad provides a matt surface, and completely removes the polished surface. The yellow pad provides a matt finish, while removing the polished surface. The green pad provides a slightly more shiny finish as compared with the yellow pad. It was noticed that the white, yellow and green pads provided a very clean floor. It was also noted that dry polishing of the flooring using the white, yellow or green pads subsequent to the wet polishing, provided gloss values similar to those of Table 10.

Hence, the pad may be used for grinding and/or polishing linoleum and plastic floors, e.g. floors having a surface comprising vinyl, polyurethane, epoxy, acrylic or other plastic material. In particular, the pad is suitable for dry polishing of such surfaces.

In a seventh additional test, the applicant's pads were tested for dry polishing of a lacquered parquet floor surface. In this test, an additional pad, termed "Orange" and having diamond particles of 2-4 micron was used. Gloss values of the floor was measured, before and after treatment, at five spaced apart points using the gloss meter referred to above. The results are shown in Table 12.

TABLE 12

| polishing of lacquered parquet surface | | | |
|---|---|---|---|
| Pad | Green | Orange | Orange |
| Initial gloss | 40 | 40 | 47-50 |
| Liquid | None | None | None |
| Final gloss | 47-51 | 58-60 | 56-59 |

From Table 12, it is noted that the pads can be used for cleaning/polishing lacquered surfaces as well. Using the orange pad provides an additional gloss increase, regardless of whether it is performed on a surface having an initial gloss value of 40 or of 47-50.

Hence, it is concluded that the pad disclosed herein may be used for grinding and/or polishing lacquered surfaces, e.g. lacquered wood surfaces, such as wood parquet floor and other lacquered surfaces (on e.g. patios or boats), wall surfaces, interior moldings, doors, baseboards etc.

According to another embodiment, the pad may be used for polishing polymer surfaces, e.g. so-called "gelcoat" surfaces, that are found on fiber-reinforced plastic structures, such as boats etc., and which typically comprise resin and optionally pigments.

According to yet another embodiment, the pad may be used for grinding and/or polishing glass surfaces, such as e.g. automobile windows/windscreens, in order to remove small scratches etc.

According to yet another embodiment, the pad may be used for grinding and/or polishing automobile bodies, and even for polishing painted surfaces on automobile bodies, i.e. automotive enamel.

Whereas the methods disclosed herein are suitable for regular treatment or maintenance, they can also be used for ad hoc polishing or grinding treatment.

The invention claimed is:

1. A method for maintaining a hard, smooth floor surface, the method comprising:

treating the hard, smooth floor surface with a flexible pad comprising an open, lofty, three dimensional non-woven web of fibers, in the presence of abrasive particles, bonded to the pad, on a contact surface between the pad and the hard, smooth floor surface, wherein the abrasive particles comprise diamond particles of an average diameter of 3 to 6 μm, and wherein treating the hard, smooth floor surface is performed using said pad having:

abrasive particles bonded thereto only in a vicinity of the contact surface, the fibers of the flexible pad are bonded to each other by a primary binder and/or via melt-bonding, and have the abrasive particles bonded thereto by a secondary binder, the abrasive particles are present throughout the secondary binder, a first portion of the flexible pad has the abrasive particles present in a first concentration, and a second portion of the flexible pad has the particles present in a second, lower concentration, and said second concentration is zero, such that the second portion is free from the abrasive particles, and wherein the flexible pad has a disc-shaped body having a thickness and a first surface, the abrasive particles being present on said first surface and down to a depth from said first surface, which depth is less than said thickness, such that said first portion is at said first surface and said second portion is at a second surface, opposite said first surface.

2. The method as claimed in claim 1, wherein the abrasive particles comprise at least one of natural diamond particles, industrial diamond particles and coated diamond particles.

3. The method as claimed in claim 1, wherein the treating step is performed using a pad having a density of less than 40 $kg/m^3$, preferably 20-35 $kg/m^3$.

4. The method as claimed in claim 1, wherein the pad, while in contact with the hard surface, is caused to move in relation to the hard surface.

5. The method as claimed in claim 1, wherein the pad, while in contact with the hard surface, is caused to rotate at a rotational speed of 100-1500 rpm.

6. The method as claimed in claim 1, wherein the method is performed using a scrubber/dryer combination floor surfacing machine.

7. The method as claimed in claim 1, wherein the treating step is performed in the absence of surface-improving agents on the contact surface.

8. The method as claimed in claim 1, wherein the treating step is performed in the absence of liquid on the contact surface.

9. The method as claimed in claim 1, wherein the treating step is performed in the presence of water on the contact surface.

* * * * *